US006564737B2

(12) United States Patent
Skira

(10) Patent No.: US 6,564,737 B2
(45) Date of Patent: May 20, 2003

(54) SINGLE-FRAME-CURVE METHOD OF DESIGNING AND CONSTRUCTING HULLS

(76) Inventor: Daniel Skira, 75 Mill St., Rockport, ME (US) 04856

( * ) Notice: Subject to any disclaimer, the term of this patent is extended or adjusted under 35 U.S.C. 154(b) by 0 days.

(21) Appl. No.: 10/213,787

(22) Filed: Aug. 7, 2002

(65) Prior Publication Data

US 2002/0189518 A1 Dec. 19, 2002

Related U.S. Application Data

(63) Continuation-in-part of application No. 09/571,807, filed on May 16, 2000, now abandoned.

(51) Int. Cl.[7] ..... B63B 3/00

(52) U.S. Cl. ..... 114/65 R; 114/61.3

(58) Field of Search ..... 114/65 R, 61.27–61.32, 114/355

(56) References Cited

U.S. PATENT DOCUMENTS 4,638,753 A * 1/1987 Marschewski ..... 114/56

* cited by examiner

*Primary Examiner*—Ed Swinehart
(74) *Attorney, Agent, or Firm*—Thomas L. Bohan; Patricia M. Mathers

(57) ABSTRACT

A method for designing and constructing original hull designs, and the hulls produced by this method. Directed particularly at frame-based hulls, the method introduces a systemizes the design process so that both the design work and the construction work can be completed in less time. It is based on a Single Frame Curve template generated early in the process and then used to draw every one of the frames in the lines drawing. Later, a full-scale version of the template is used in lofting the lines drawing and in creating the physical frames themselves. It introduces consistency and goodness checks into the creation of original designs, funneling the designer's creativity into the production of a new boat of original design in a relatively short time, a new boat that is hydrodynamically smooth as a consequence of the interrelations imposed between and among the template-based frames.

10 Claims, 10 Drawing Sheets

SINGLE-FRAME-CURVE METHOD OF DESIGNING AND CONSTRUCTING HULLS

This application is a continuation-in-part of U.S. application Ser. No. 09/571,807, filed May 16, 2000 now abandoned.

BACKGROUND OF THE INVENTION

1. Field of the Invention

The invention relates to hull design and construction and in particular to the creation of original hull designs and the construction based on them. More particularly, the invention relates to a method for systemizing the creation of an original lines drawing in a way that permits the hull-defining frames to be drawn from a single template and the physical frames to be constructed from a single template, so as to shorten the time required at both the design and construction stages for any type of frame-based watercraft that is not a reproduction or facsimile of an earlier vessel. Furthermore, the use of the single template to define the curve along the entire length of the hull results in less turbulent, and hence more rapid, passage of the resulting boat through the water.

2. Description of the Prior Art

An original hull has a shape not previously in existence. It is based on drawings created specifically for the vessel of which it is a part, which is therefore an original vessel. Designing and constructing an original vessel are time- and labor-intensive undertakings; hence, the high cost of owning a original vessel, and the relatively small number of boatyards specializing in original boat design and construction.

Although mention of unique vessels often conjures up wooden sailing craft, originally vessels currently being built are by no means limited to that type of watercraft or to that material. At any event, decisions regarding type and material are usually, though not always, made before the designer and the builder of the craft have been hired. Typically, the designer will have as givens, in addition to the type and material, the overall length and beam (width) of the vessel. Starting with those parameters, and usually the load-bearing capacity of the original vessel to be created, the designer relies on his experience, education, and instinct (his design sense) to produce the drawing that will serve as the vessel's blueprint. This is the "lines drawing," the lines including the sheer line (defining the top of the hull, where the hull joins the deck), and the hull's bottom line (which incorporates the keel line, where the hull joins the keel, if there is to be a keel), and the water line. They also include a number of the hull's longitudinal contours as well as the (related) shape of the hull's transverse cross-sections at many locations ("stations") along the length of the vessel. These cross-sectional shapes define the shapes of the frames that will form the skeleton of the vessel. The more complex the hull shape, the more such cross-sections are necessary to define the design for later construction. The lines drawing, in combination with a table of offsets numerically specifying the locations of particular points within the hull, defines the new hull. It is typically drawn to a scale of 1:24 (half-inch to the foot) and, when complete, expanded to a full scale ("lofted") version. In the case of traditional wooden-boat construction, this lofted version is painted on the floor of the boat builder's shop.

Among boat builders and designers, important term and practice is "fairing," or "making fair" the lines of a design. Also, the lines of an existing boat can be described as "fair" or "not fair." This refers to the smoothness of the lines, and also to their relative monotonicity. A sheer line is fair if it makes a continuous sweep from one end of the vessel to the other, typically sinking as it progresses from the stem to midships, then rising again as it progresses the rest of the way to the stern. It is not fair, however, if during this sweep it falls and rises repeatedly and/or for no logical reason.

One of the reasons for the traditional of transferring the scale lines drawing to a full-size version is to check for the fairness of the lines. Irregularities not visible on a small scale may show up in the full-scale drawing.

The physical hull is built up starting with construction of its skeleton, the series of frames oriented perpendicularly to, and deployed along, the hull's longitudinal axis. The shape of each frame is defined by the shape-given the hull at that station during the design stage. Working from the full-scale drawing, the builder constructs each of the full-scale frames. When the building material is wood, one may make molded frames by bending a single piece of wood bent to the proper shape using a mold, which in turn was made using the full-scale drawing. Alternatively, one may make sawed frames out of a single large piece of wood or, more commonly, several pieces of wood affixed to one another and then the composite sawed to the proper shape. For the latter approach, a full scale drawing of the individual frame may be made on plywood or the like to serve as an outline for the sawing. Once constructed, each frame is placed at the proper station in the hull taking shape overhead as the construction progresses.

The number of frames needed depends on the requirements of the vessel; typically it is several score. Although there is a relationship between the frames determined by the architect's drawing, there is no simple way of determining the shape of one frame from the shape of another frame, even a neighboring one. The drawing and construction of frames contributes significantly to the total time, and hence expense, of building a newly designed vessel. The need to derive and construct each frame as a separate undertaking is one of the factors that makes the construction phase so lengthy.

For more than 100 years, extending down to the present time, the method just described is the way that original hulls have been created. For all that time, much of the cost of producing hulls has come from this frame by frame by frame approach. Although a hull, once designed and constructed, can form the mold for repetitive and relatively inexpensive copying, originality of design is a good that has always driven the market for new boats, especially where sailing craft and other sporting boats are concerned. It is, however, a good that is difficult to acquire because of the high cost of producing unique boats.

Therefore, what is needed is a method to produce original hulls in a manner requiring less time than the method now in use. What is further needed is a method that is more efficient both at the design stage and at the construction stage of original hulls. What is yet further needed is such a method that can be implemented in the boat-building craft as it is presently constituted.

SUMMARY OF THE INVENTION

The object of the invention is to introduce an approach to the creation of hull designs that allows the designs to be more efficiently created. It is a further object of the invention that the designs thus created permit the hull-construction based on them to be carried out with less effort and time than is the case with current hull designs. Finally, it is an object of the invention that the efficiencies made available by the new approach be immediately adaptable by existing naval architects and boat shops that produce either wooden or non-wooden vessels.

The present invention meets its objectives by a reversal of the traditional approach to hull design. Instead of first creating the lines drawing and then determining from that drawing the shape of the individual frames, the design approach of the present invention involves generating the lines drawing from the shape of a single curve, a Single Frame Curve (SFC), which can also be referred to as a Master Curve. Then, during the physical construction of the hull, the Single Frame Curve is used to generate all of the frames for all of the stations, each of the individual frame shapes being found along a segment of the Master Frame. Because of the single-frame approach made possible by the present invention, only one frame curve need be designed, only one frame mold need be constructed, and—because all frames are just different segments of the same curve (that of the Single Frame Curve)—there is less chance of error in the lofting of the frames. The method begins to be implemented at the hull-drawing stage, where the Single Frame Curve template is created, and later carries through to the actual construction of the hull.

Although the details of the hull are generated from the Single Frame Curve, the latter is created in detail only after the general lines of the desired hull are limned. With no constraints other than beam and length specs, the architect/designer produces a lines drawing limited to the profile (side-view) and deck (top-view), using the keel line (or other hull-bottom-characterizing line, such as the rabbet line). Then a horizontal line is added to the profile to represent the initial Design Water Line (DWL). At this point, very little has been defined regarding the details of the hull. Not having provided the hull shape at any station, let alone a distribution of stations, it is not possible to say any about the shape of the water line, that is the outline of the hull's intersection with a horizontal plane passed through it at the DWL.

Next, a number of vertical lines are added to the diagram, defining the respective positions of an equal number of stations, typically ten. Generally, these will be equally distributed between the fore and aft intersections of the DWL with the bottom of the hull, as is traditionally done in the first stages of hull design. The deviation from the traditional approach begins with the following step, when the designer draws a tentative curve to represent the shape of a frame at a station near or at the widest portion of the hull. After a series of iterations, to be described below, this tentative curve is "morphed" into the Single Frame Curve that is at the heart of the inventive method. It is important to realize that this method neither deprives designer of originality, nor adds to his or her artistic and engineering sense, but provides a way in which the abilities of the designer are more likely to result in a new boat being built. It does this by allowing the designer and boat builder to practice their respective crafts jointly and less expensively and hence to find more outlets for them. An analogy may be made with the sculptor who, after working for years with hammer and chisel, is provided with a power tool that when properly handled can remove stone as precisely as the hammer and chisel, though at a much faster rate. Thus, the new tool and method are a contribution to the sculpture's practice, even though the engineer who created them is not able to tell the sculptor how to produce an artistically pleasing sculpture with them. The final product will still depend on the skills of the sculptor.

In drawing the tentative single-frame template ("test frame"), the only constraints facing the designer, once the station has been chosen, are the are the respective distances that the top and bottom of the frame are offset from the vessel's centerline. The designer then uses his or her instinct to shape the test frame. Aiding in this is the DWL, since in drawing the test frame, the offset of the point on that test frame which intersects what waterline is apparent. That is, the shape of this test frame defines how far the water line is outboard from the centerline at the station chosen. At any event, the test frame provides a single data point regarding the shape of the water line as viewed from above or below. With that point defined, the designer draws in the rest of the waterline, again based on his or her skills and vision for the boat. This defines the hull's shape at the waterline, a shape that may be changed as the process continues.

After the test template is drawn to comply with the shape that the designer wishes to give to a frame at a midships station, it is extended at the top (above the deck height) and below (below the keel line). The goal is ultimately to have a curve, longer that any particular frame, having a shape such that each frame in the hull will be able to be matched up with one or another portions of the curve. That will be the nature of the SFC that emerges from the first part of this process. It is because the hull at midships is usually most defining of the type of vessel being designed that the midships station is the one normally chosen as the starting point, so that the frame there will comply with the central portion of the SFC.

Having begun with the test frame and resulting test SFC, the designer using this method then works back and forth between the shape of the SFC and the shape of the hull until a particular goal is reached. That goal is to have (1) an SFC that satisfies the requirement that every frame on the hull can be fit at some portion along the SFC curve and (2) the hull design that results is fair and comports with the designer's objectives. The iteration stage—to be explained in some detail below—will typically go through several cycles before all the proper elements of the hull design come into balance. When it is completed, the SFC is used to draw all of the frames that are desired in the small scale drawing. The scale drawing is then lofted (scaled up) in the boat shop, typically being laid on the floor. Concurrently, a Master mold is produced from the SFC, a single mold that can be used for the construction of every one of the physical frames that are to become the backbone of the boat.

Because the trial-and-error portion of the method is executed with paper and pencil on a small-scale drawing at the outset, the overall process of preparing full drawings and of constructing the vessel is completed with a significant savings of time and materials in comparison with the present means of designing, lofting and constructing boats.

The details of the iterative stage are as follows. For definitiveness, it is described in terms of traditional materials, including paper. It is understood, however, that the most widespread application of the method in the future will be done with the use of computers. The translation of the steps set out below from traditional materials to software counterparts of these materials will be obvious to those having professional kills in modern boat building, a field that is turning ever more to the use of computers for design and construction. It is also to be understood that where some definite traditional material, such as tracing paper, is mentioned there is no intention of limiting the method to that specific material. The use of any materials or technology enabling one to achieve the steps called for will be within the ambit of the present invention.

Using traditional materials, the designer transfers the tentative SFC to tracing paper, and lays the tracing paper onto one of the stations near the stem or stern of the hull as depicted in the initial lines drawing. This is because it is generally in those stations that the frames will differ the most from those amidships. (Depending on the particular type of vessel, this may not be true. To continue to provide definitiveness to the discussion, a particular vessel is envisioned, namely a sailing craft. However, the method of the present invention can be applied across the entire range of boats, from small sailboats and motor launches through large oil tankers and indeed submarines. It has value wherever the boat in question is to be of a new design.)

With the tentative SFC overlaying the station near the stem or stern, the designer seeks to find a portion of the tentative SFC that will have the shape and extent of a frame that meets the conditions required at that station. The conditions are that the bottom of the frame coincide with the keel line's position at that station, that the top of the frame coincide with the sheer line at that station and that the frame intersect the waterline at the point dictated by the waterline curve drawn earlier in the process. In other words, the frame must extend between the keel line and the sheer line and intersect the DWL (water line); the latter condition is meant if the frame, at the height of the DWL, is the same distance outboard from the center line as the DWL itself. In practice, the test of these conditions is carried out by referring to both the side view and the top view in the lines drawing.

In summary, one must be able to position the SFC so that a portion of it extends from the proper point on the keel line to the proper point on the sheer line and has the proper offset at the height of the waterline. If this is not possible, something has to modified. It can be the shape of the waterline. It may be the shape of the SFC. If the latter's shape is modified in its central region, which tracked the originally selected midships frame, then the latter itself must be modified. This is unusual, however, given that some thought went into the first-order drawings. It is more common to have little or no modification necessary or that, if a modification in the SFC is indicated, it can be done outside the central region of the curve.

When, after a few iterations, the SFC can be made to fit both the initially chosen frame (or a slightly modified form of it) and provide the shape of an acceptable frame at one or two points at the extreme ends of the hull, the operational SFC has been attained. It is important to note that the freedom of design is primarily exercised when drawing the initial lines of the vessel, including the hull shape at the waterline and the tentative SFC, at the outset. The other frames drawn at the design stage are to a large extent pre-determined by the choices made at that point.

Once the operational SFC has been attained, a piece of cardboard or some other stiff material is cut out so that one edge corresponds to the SFC shape. This forms the template that will be used for drawing in the frames at all of the other stations. Before drawing these frames, however, the designer places a Reference Mark near the midpoint of the template. (The exact position is not critical.)

The frames are then drawn using the side-view perspective of the lines drawing. At each station, a portion of the template is found that will permit a frame satisfying the conditions at that station, as was done at the stage where the tentative SFC was tested at the stem and stern of the hull. As one progresses from one station to the adjacent one, one attempts to find the desired frame shape as close as possible on the template to where the previous frame shape was found (this normally occurs automatically, because of the absence of equivalent shapes at more than one place on the template). At each station, in addition to drawing the frame in, the designer makes a mark (a Reference Point) at the point where the Reference Mark on the template is located. This is typically done at ten different stations, distributed equally from the aft frame to the front frame. However, there will generally be considerably more frames actually constructed during the physical creation of the boat.

After the frame curve at each of the pre-selected stations has been drawn, the designer draws a smooth curve, the Reference Line, that passes through all of the Reference Points. The Reference Line should have a shape corresponding to the type of boat being designed and, within that type, with the form for the boat envisioned by the designer. For example, the hull of a sailing yacht will have a relatively narrow bow (stem) and wider stern. For such a case, Reference Line should arc upward toward the deck line as it approaches the stern, and, conversely, become flatter and closer to the keel line as it approaches the bow. If the Reference Line does not look appropriate for the type of boat being designed or if its slope is varies rapidly as one progresses along the length of the vessel, the designer needs to return to an earlier stage in the process and reexamine his or her choices for basic lines. In particular, the designer may reshape the SFC or reposition the template at any of the stations (for drawing the frames) as many times as is necessary to effect the desired result. It is anticipated that the need to re-iterate once the Reference Line stage has been reached will not generally occur with experienced designers, at least after their first few efforts with the SFC method.

If the Reference Line is fair, then one advances to the next stage, which involves adding in the additional frames that needed to guide the ultimate construction. This is easily done using the Reference Line. The template is placed at each station where one wishes to add a frame curve, taking care to position the template so that the Reference Mark on it coincides with the Reference Line's intersection with that station. With the Reference Mark so placed, it is only necessary to rotate the template so that it makes contact with the sheer line and keel lines, respectively. The waterline should take care of itself, given the preparatory steps preceding this stage.

Once the design of the hull's shape has been completed, the scale diagram is lofted to full scale in the boat shop. However, unlike the traditional approach, it is not going to be necessary for the boat builder to work so intensively with the drawing. This is because of the known relationship between the different frames. One approach to implementing this knowledge is to construct a single mold reflecting the SFC developed at the design stage. Then every single frame can be constructed using this mold, though different frames in general will be build using different portions of the mold.

The following is a summary of the method of this invention, presented in recipe form. It is to be understood that the invention is not limited to the specific details given below, details such as the prescription that a line be dashed that are provided just to add definitiveness to the instructions. It is also understood that most of the detailed steps set out in this "recipe" are already well understood by professional boat designers and are only included here for completeness. In particular, the concept of working iteratively in completing a drawing is well understood.

Single Frame Curve Method as Recipe

1. Choose and lay out the proposed vessel's sheer line and bottom line commensurate with the vessel's beam and length requirements on (a) a half-breadth top view, defined by the sheer line and the centerline, and (b) a profile view ("side view") defined by the bottom line, which will include the keel line, and the sheer line. To the half-breadth top view add the half-breadth keel line as a dashed (invisible) line. On the side view, show the desired height of the waterline as a dashed horizontal line. The two views are to be given their traditional locations, the top view being placed directly above, and aligned with, the side view. Also, as is the traditional practice, the half-breadth top view depicts the port side of the vessel and the profile view the starboard side. This has only formal significance, given the vessels' bilateral symmetry. (It is also traditional in the lines drawing to include a half-width longitudinal view depicting the frames at a number of stations. It is composite since in the same planar drawing the port-side half of the frames as viewed from the stem are shown along with the starboard half of the frames as viewed from the stern. In this recipe, this longitudinal view is not used. Instead, as a short-cut, the half-frames will be depicted on the side view, each to be shown perpendicular to the vertical line representing it respective station, all as to be disclosed below.)

2. Add to the drawing ten vertical lines depicting ten stations, the forwardmost and aftmost stations coinciding, respectively, with the forward and rear intersections of the DWL with the hull's bottom line. These vertical lines will pass through both the top view and the side view. The resulting station closest to midships will be designated the "midships station," even though it is not exactly midships.

3. Where the midships station appears on the side view, draw in a midships frame (actually a half-frame), comporting with your view of how it should be shaped, having as constraints the half-beam and the half-keel width at that point. In showing this midships frame on the side view, present the transverse view in the plane of the paper. The upper end of the half-frame will be displaced to the right of the midships' station by a distance equal to the half-width of the vessel at that station and the lower end of the half-frame will be displaced to the right of the station by a distance equal to the half-width of the keel at that station.

4. From the midships half-frame just drawn, determine from the horizontal representation of the D.W.L. the point on the frame that will intersect the waterline. Make a mark on the top view indicating that point (which would be an "invisible point" on the drawing, being obscured by the deck or by the bulk of the hull itself). This is the first point on the two-dimensional shape outlining the vessel's intersection with the plane of the water.

5. Based on the type of vessel being designed and your own designer's instincts, draw in the rest of the two-dimensional shape outlining the vessel's intersection with the plane of the water, taking care that it pass through the point marked in step 4. Although the details of the waterline are left to the professional knowledge and instincts of the boat designer, its exact shape may be altered at a later stage in the process as a result of the feedback that the present method provides to the designer.

6. Laying a piece of tracing paper over the midships frame, trace that frame, and then extend it at the top and the bottom, respectively. This extended curve will be the tentative Single Frame Curve, which, either as it stands or after some modification, is to be the operational Single Frame Curve (SFC) that will govern the design and construction of all of the frames of the vessel to be built by this method.

7. Using the top view for offset information (e.g., how far outboard from the centerline the waterline intersects the hull at that point), place the tentative SFC on the side view at one of the stations near the stem, and try to find a portion of that tentative SFC that will "fit" the half-frame at that station. A "fit" is achieved when a portion of the SFC is found that extends from the sheer line to the bottom line and has the same offset from the center at the waterline as the waterline itself does.

8. If no portion of the tentative SFC satisfies the conditions to represent a half-frame at the station chosen in the previous step, introduce the smallest modification in either the tentative SFC or the waterline that allows a fit to be made. If you made the modification to the tentative SFC in its central region (an unlikely circumstance) bring the modified curve back to the midships station to make sure that it still fits the midships frame. If it does not, the midships frame may be modified.

9. Do the same thing with one of the stations close to the stern of the vessel. Note that the tracing paper will have to be flipped over to do this, given the traditional depiction being used, where the port half of the frames are shown for the fore-body, and the starboard side of the frames for the aft-body.)

10. Once the tentative SFC, adjusted or not, works for the several test stations, it has attained the status of operational SFC. At this point cut a piece of cardboard so that one edge of the cardboard is in the shape of this SFC; the cardboard will serve as the SFC template for drawing half-frames for the fore-body and aft-body.

11. Place a Reference Mark at approximately the center of the SFC template, making sure to mark it on both sides. The exact location of the Reference Mark is not important, as long as it is somewhere in the central area of the SFC.

12. Using the SFC template, draw in frames corresponding to a few of the stations defined by the vertical lines introduced earlier, using the convention in which all of the half-frames seem to emanate from near the midships station. That is, the offsets of all of the half-frames drawn in are shown with respect to the midships station. The offsets in question are for the half-beam, the half-keel (for those half-frames that connect with the keel) and the waterline. As each half-frame is so drawn, note and mark the height with respect to the bottom or sheer line at that station where the Reference Mark falls. Using that information about the Reference Mark associated with each station where the half-frame is drawn, place that a mark on the side view at the respective station.

13. Using the Reference Points placed as described above, draw a smooth line that passing through those marks. This is the Reference Line, and it should have a smooth sweep to it, and not be significantly non-monotonic, i.e., not go up and down repeatedly as it moves from the front of the hull to the back. Another way of saying this is that it should be fair. If it is not, you must re-examine some of the choices you made along with way, with respect to the ship's lines.

14. If the Reference Line is fair, the frames can be quickly drawn in at the rest of the stations defined earlier. This can be done either using the central-body transverse view or by going directly to station of interest. First the latter approach will be spelled out. Note where the Reference Line intersects the station of interest, and draw a horizontal line through that point. Place the SFC template so that the Reference Mark lies on that horizontal line. Then pivot the SFC template about Reference Mark (which remains fixed in position on the drawing), so that a portion of it bridges the distance between the sheer line and the bottom line of the hull at that station. (The latter step can be facilitated by first drawing two more horizontal lines through the station of interest, one at the height of the station's intersection with the sheer line and the other at the height of the station's intersection with the bottom line, marking on those two horizontal lines the respective offsets of the sheer line and bottom line for that station.) Alternately, one can transfer the Reference Point to the proper position with respect to the midships stations and draws in the new frame within the conventional body design emanating from that station.

15. You now is in a position to do the half-frames for stations in between the ones defined at the outset. For example, one could do the half frame for the station halfway between the sternmost station and the next station forward, interpolating to get the correct offsets needed to orient the SFC template at each station after pinning it down using the Reference Line and Reference Mark. In this way, create all of the frames that the vessel needs for a sufficient specification of its shape and subsequent construction. This number may be as few as ten or as many as one hundred or more, depending on the type of vessel being created.

16. At this point, the lines drawing is completed, and can be used to make a three-dimensional scale model as well as to produce a full-size drawing on the floor of the shop where the vessel is to be constructed. For the latter, you first scale up the SFC template so as to produce full-size SFC template. A mold is also made from the full-size SFC template, a mold that will used in the traditional manner to make all of the frames for the vessel.

DETAILED ILLUSTRATION OF THE INVENTION

In order to further explain the method of the present invention, it will be described in detail as used in the design and construction of a particular type of watercraft, a wooden schooner. There is no intention, however, to suggest any limitation on the scope of the invention, and, in particular, any limitation to a specific type of hull or particular construction material.

Figure 1:
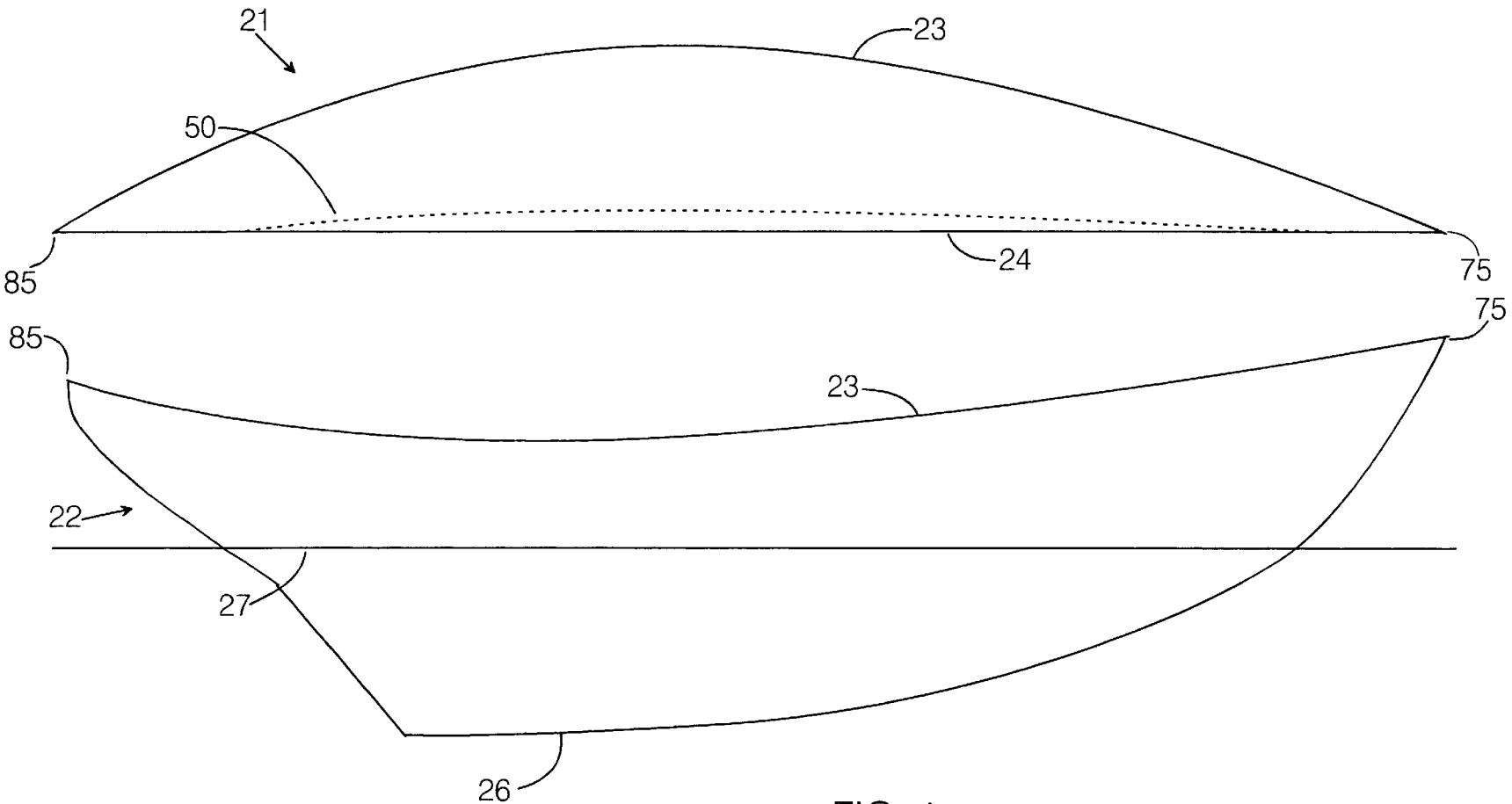
FIG. 1 shows a half-breadth top view and a profile (side) view of a hypothetical vessel used to illustrate the method of the present invention, the top view being aligned with and positioned above the profile view.

FIG. 1 depicts a side-view 22 and a half-breadth top view 21 of a prospective hull as defined by a sheer line 23, a bottom line 26, and a centerline 24, the latter extending longitudinally from a stem 75 to a stern 85. Before the single-frame curve method is introduced, the hull design already incorporates and otherwise reflects the choices that the designer has already established at the outset for length, beam (width), and sheer line 23, the latter being visualized in FIG. 1 through the combination of the side-view 22 and top view 21. In addition, the designer has defined the vessel's freeboard and draft by introducing a depiction a waterline 27 on the side-view 22. This is only a partial definition of the Design Water Line (DWL), however, since there is not yet a depiction of the waterline 27 on the top view 23, and hence no definition of the shape of the hull at the plane of the water. Finally, as shown in the top view 23 in FIG. 1, the designer has introduced a half-keel line 50, indicating that this vessel is intended to have a keel separate from the hull, half-keel line 50 marking where the hull and keel are to be joined together. From half-keel line 50 it can be seen that the keel will not extend along the entire bottom line 26 of the hull and that the line of attachment, the rabbet line, will be entirely under water.

Figure 2:
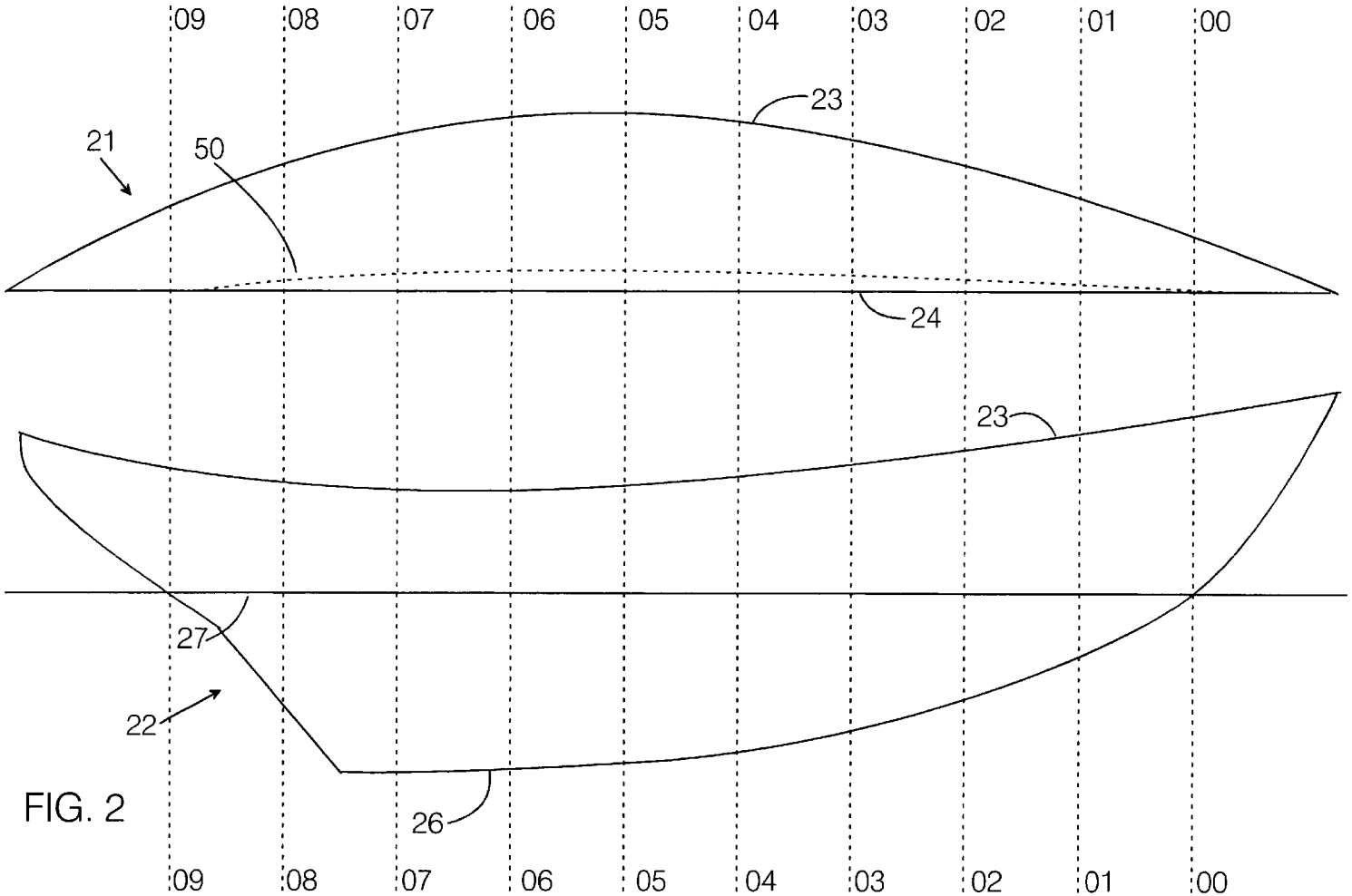
FIG. 2 is the same as FIG. 1, except that ten vertical lines have been added to represent ten different stations along the length of the vessel.

FIG. 2 shows ten vertical lines added to the lines drawing to indicate ten stations. One of the central stations is defined as midships station 05. The stations forward of the midships station 05 are stations 00 through 04, respectively, and those aft are stations 06 through 09, respectively.

Figure 3:
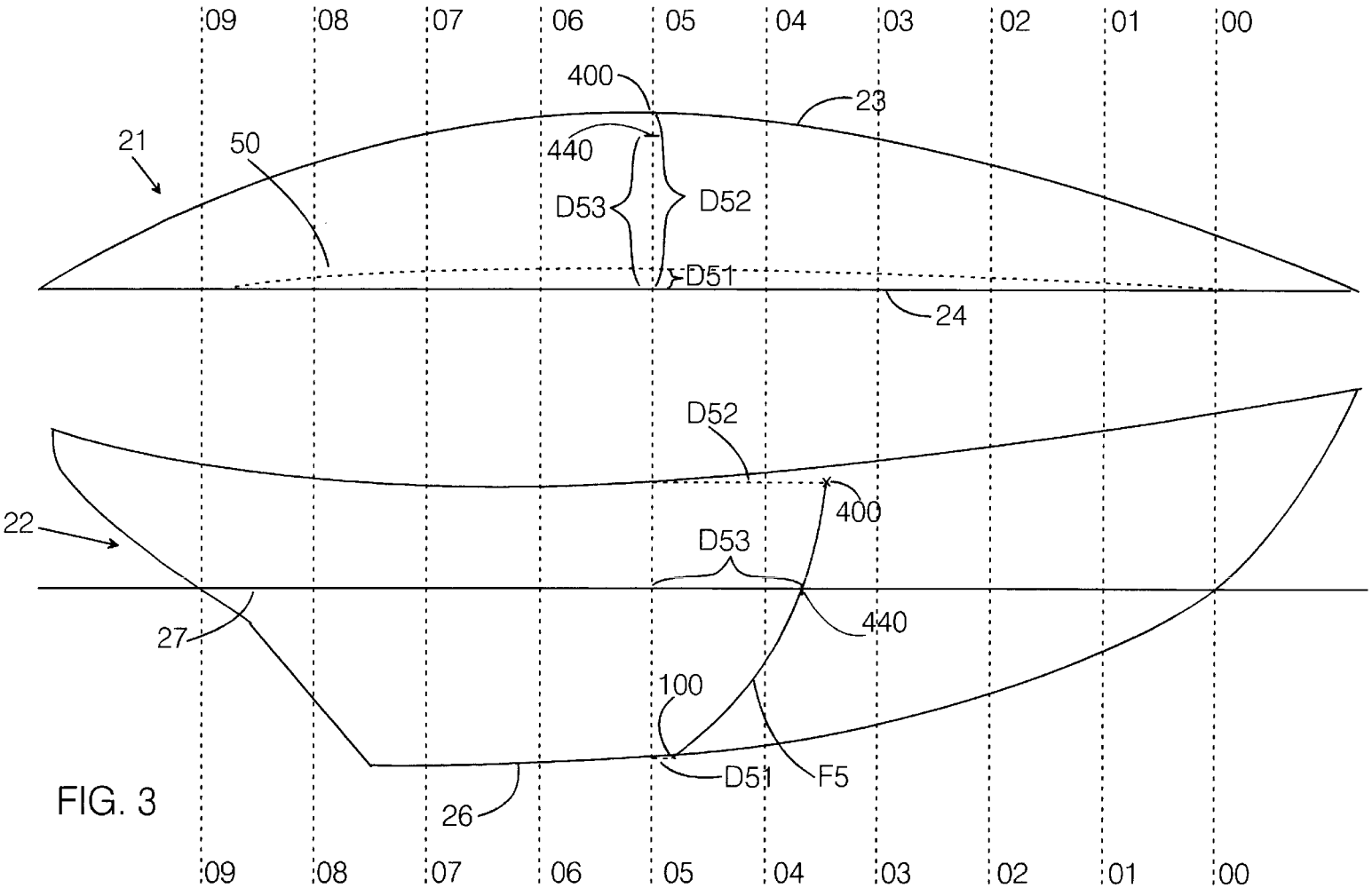
FIG. 3 is the same as FIG. 2, but now a half-frame has been added at the midships station in the profile view, where it is shown extending between the sheer line and the bottom line corresponding to that station.

In FIG. 3, the designer has introduced a midships frame F5 (actually a half-frames), using the central-body view where all of the transverse elements are shown in the side view 22 as if they were associated with the midships station 05. It can be seen that the midships frame F5 has been drawn so that its bottom extremity is displaced horizontally from the midships station 05 by a distance equal to the midships-station half-width of the keel D51. This is illustrated in the top view and side view at that point. Similarly, a midships-station sheer-offset distance D52 is found from reference to the top view 23. The midships-station sheer-offset distance D52 is the distance from the centerline 24 to a midships sheer point 400, where the midships frame F5 intersects the sheer line 23. In positioning and drawing the midships frame F5, then, the upper extremity is displaced horizontally to the right from the midships station 05 a distance equal to the midships-station sheer-offset distance D52, as illustrated in the side view 22 in FIG. 3.

One can see from the side view 22 in FIG. 3 that the midships frame F5 intersects the waterline 27 at a midships-waterline-point 440 which has a midships-waterline-offset-distance D53. In order to locate this midships-waterline-point 440 on the top view 21, it is just necessary to measure out on the midships station 05 from the centerline 24 a distance equal to the midships-waterline-offset-distance D53. This is illustrated in FIG. 3. This provides one point on the line defining the intersection of the hull with the DWL. Note that midships-waterline-point 440 will be an invisible point on the topview 21 though not on the side view 22.

Figure 4:
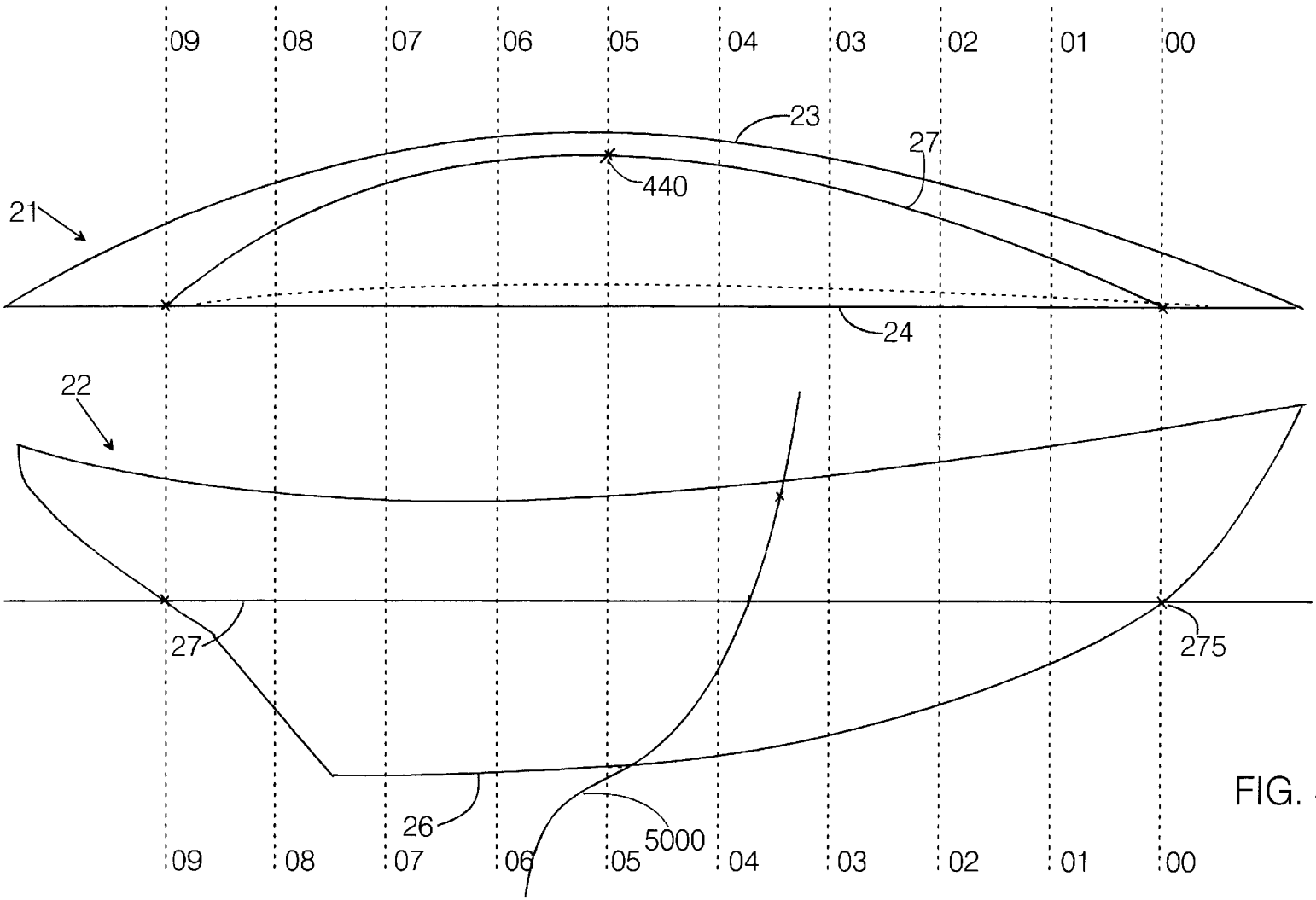
FIG. 4 shows the midships half-frame extended at the top and bottom to form a tentative Single Frame Curve (SFC).

With the midships waterline point 440 constituting a single point of the two-dimension intersection between the hull and the DWL, the designer then draws in the rest of the waterline 27 on the top view 21, as shown in FIG. 4.

Although the waterline 27 shown be shown as an invisible line on the top view 21, for clarity it is shown as a solid line. It is to be emphasized that the exact shape of the waterline 27 as it appears on the top view 21 is chosen by the designer at this point, subject only to the designer's professional judgment and the constraint that the waterline 27 must pass through the midships-waterline point 440. Recall that the latter point was defined by the shape of the midships frame F5 selected by the designer.

With continuing reference to FIG. 4, and in particular to the side view 22 one can see that the midships frame F5 has had extensions added at the upper and lower ends, respectively, and now constitutes a tentative Single Frame Curve (SFC) 5000.

Figure 5:
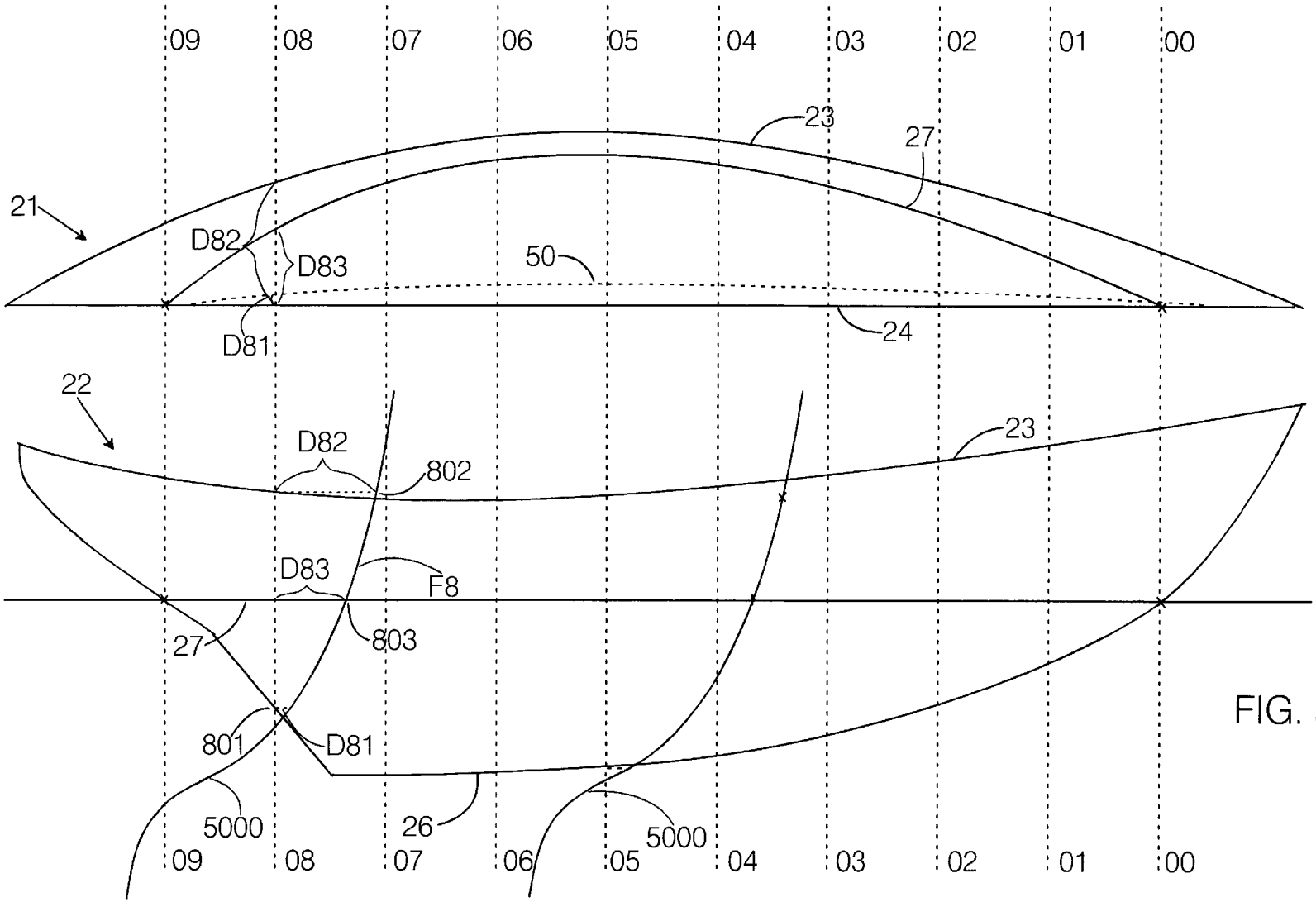
FIG. 5 shows the tentative SFC being tested at a station near the stern.

The next step is to test whether the tentative SFC 5000 will be acceptable, or whether it has to be modified, the test being to see whether one portion or another of it can serve as a template for each of the other frames. After transferring tentative SFC 5000 from FIG. 4 to translucent tracing paper (not shown explicitly) so that its outline can be superposed at the other station lines on the side view 22, the tracing paper is moved to one of the stations near the stem 75 or near the stern 85, since the hull shape near the ends will deviate the most from its shape at midships and will thus supply the greatest test for the tentative SFC 5000. For definitiveness, station 08 near the stern 85 is used, as shown in FIG. 5. The same offset constraints must be met by the frames as each station as were met by the midships frame F5 at midships station 05. Thus frame F8 at a station 08 must be able to be drawn with its upper and lower extremities having proper offsets from the centerline and, moreover, frame F8 must have the correct waterline offset, since the waterline 27 as shown in top view 21 now defines the waterline offset along the entire length of the vessel. Thus, the test is to find a segment on tentative SFC 5000 that can be placed so that it extends from a station 08 rabbet point 801, where the frame F8 meets the keel line 50 up to the station 08 sheer line point 802, where the frame F8 must meet the sheer line 23, while also passing through the station 08 waterline point 803 where frame F8 must meet the waterline 27 chosen earlier in the process. These conditions are derived graphically, working with the top view 21 to measure a distance D81 outboard from the centerline 24 to the station 08 rabbet point 802 (that is, the half-width of the keel at station 08), then to measure a distance D82 that the sheer line 23 at station 02 lies outboard of the centerline 24 (the sheer offset distance at station 08), and then to measure a distance D83 that the waterline 27 at station 08 lies outboard of the centerline 24 (the waterline offset distance at station 08). These three offset distances are then transferred to the side view 22, where they are displayed as horizontal displacement from the station 08 at the heights where the keel-line, the waterline, and the sheer line, respectively, intersect station 08. Then, placing the tracing paper bearing the tentative SFC 5000 near station 08, the designer locates a segment on tentative SFC 5000 that can be made to pass through all three of the three points, as illustrated in FIG. 5. After successfully meeting a similar test at a station near the stem 75, this tentative SFC 5000 is found to be an operational SFC 6000.

It has been found that after a little practice with the SFC method, the designer is essentially always able to extend the midships frame into a curve that will serve as an operational SFC. However, occasionally, when a designer is a novice at the method, it may be that the tentative SFC 5000 that he has drawn will not have a segment on it that will satisfy the shape constraints at one of the ends of the hull. In such a case, it is necessary to modify the tentative SFC 5000 in one of the extended sections, so it does serve as a template for the end frames. Alternatively, the designer can choose to minimally change the waterline profile 27 that had previously been selected, so that the tentative SFC 5000 would "work" at station 08 without any modification. In this manner, with slight modifications of the tentative SFC 5000 and/or the waterline 27, the internal consistency of the drawings is achieved and an operational SFC 6000 attained.

Figure 6:
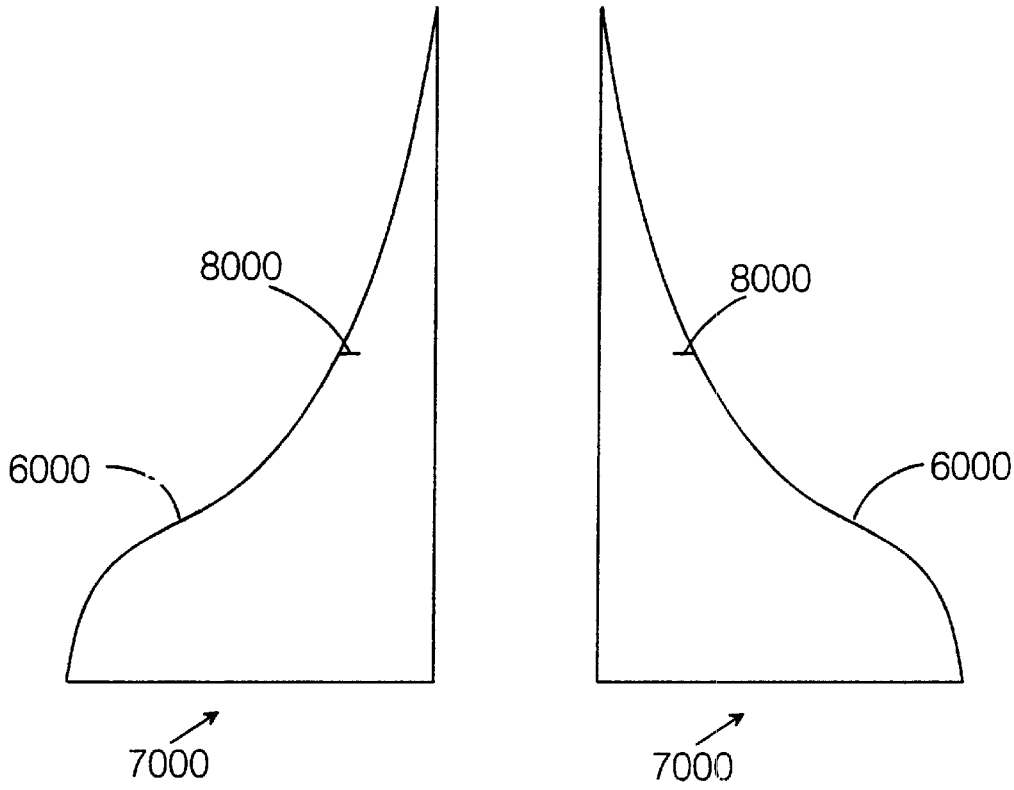
FIG. 6 shows the two sides of the SFC template with the Reference Mark placed at approximately the midpoint of the template curve.

Once the operational SFC 6000 is established, its shape is transferred to a piece of cardboard, resulting in an SFC template 7000, as depicted in FIG. 6. The SFC template 7000, which will shortly be used as a guide for adding to the lines drawing the rest of the frames at stations 00 through 09.

Figure 7:
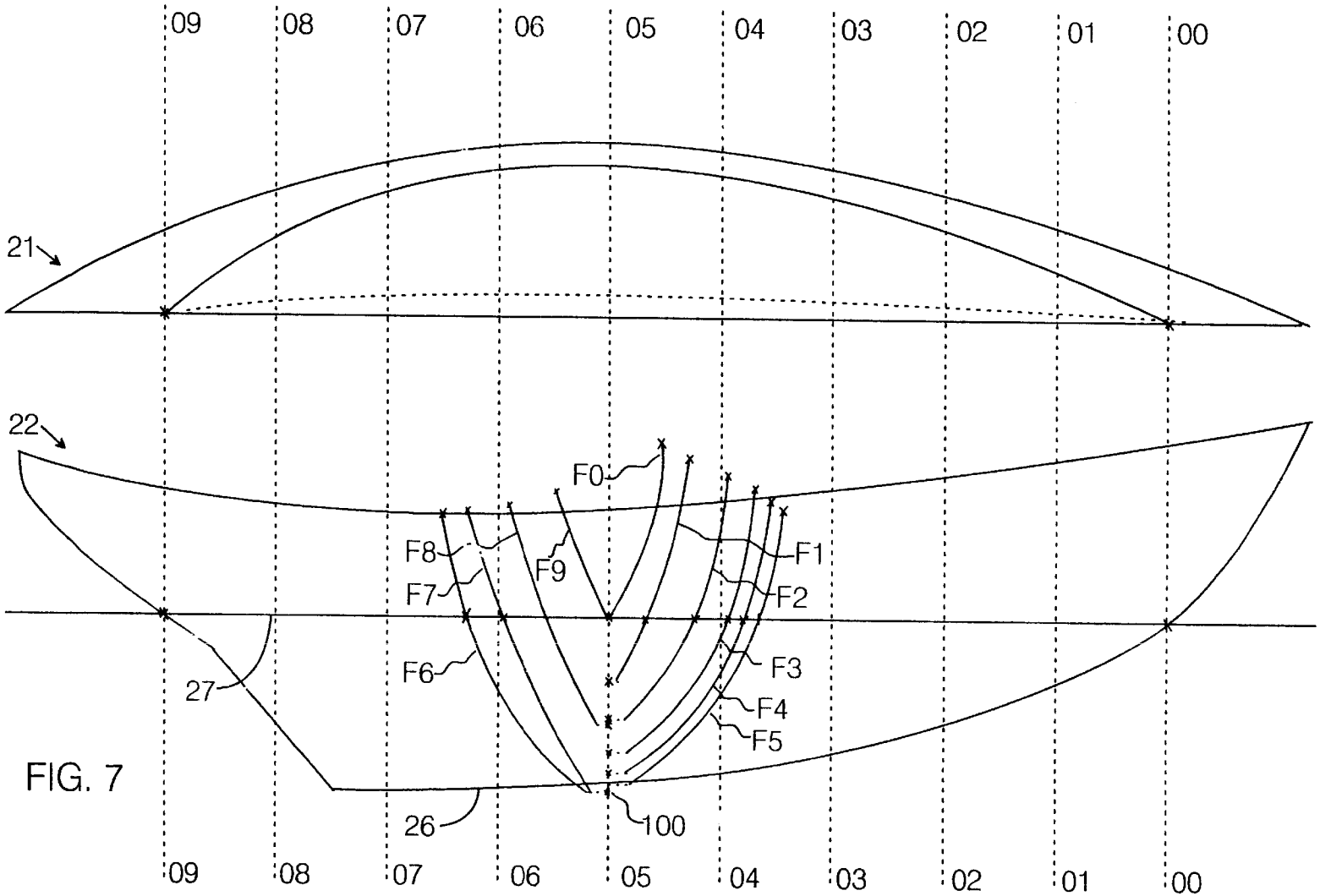
FIG. 7 depicts the frames drawn using the SFC template and corresponding to most of the pre-selected stations, all shown on the profile view.
Figure 8:
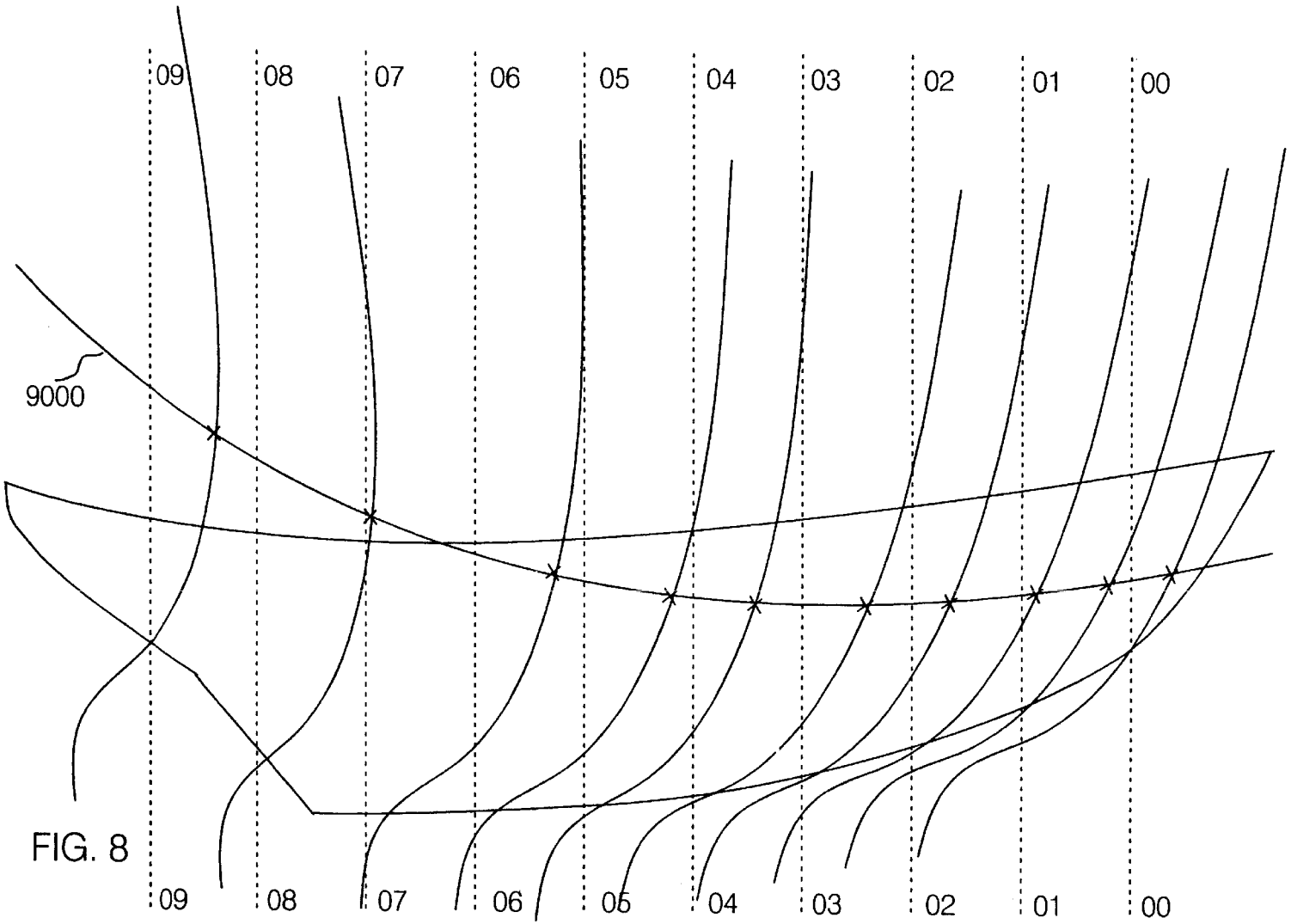
FIG. 8 shows just the side view on which a half-frames have been drawn in using the SFC template for all of the pre-selected stations, with the resulting positions of the Reference Mark at the different stations is also shown with the Reference Line drawn through these positions.

Also as shown in FIG. 6, a Reference Mark 8000 is placed on both sides of the SFC template 7000, at approximately the center. The exact position of the Reference Mark 8000 is not critical. Next, the SFC template 7000 is used to add in the rest of the frames at the pre-selected stations along the hull. FIG. 7 shows a number presented in the traditional body design as emanating from the midships station 05. FIG. 8 shows the locations of the SFC template 7000 when positioned to trace out the respective frames at their respective stations. Also shown on FIG. 8 are the ten places where the Reference Mark 8000 on the SFC template 7000 lines up when the ten frames are being drawn using the SFC template 7000. It also shows a Reference Line 9000 passing through the series of points transferred from the Reference Mark in the framing process. The Reference Line 9000 shown in FIG. 8 is fair, as that term as been used earlier, and is understood by boat builders and designers. It has been the experience of the inventor that following the procedure as set out above always results a Reference Line that is fair. Nevertheless, it is not possible to say that this will always be the case in extreme situations, and so this must be looked upon as one of the check points for the validity of the design.

Figure 9:
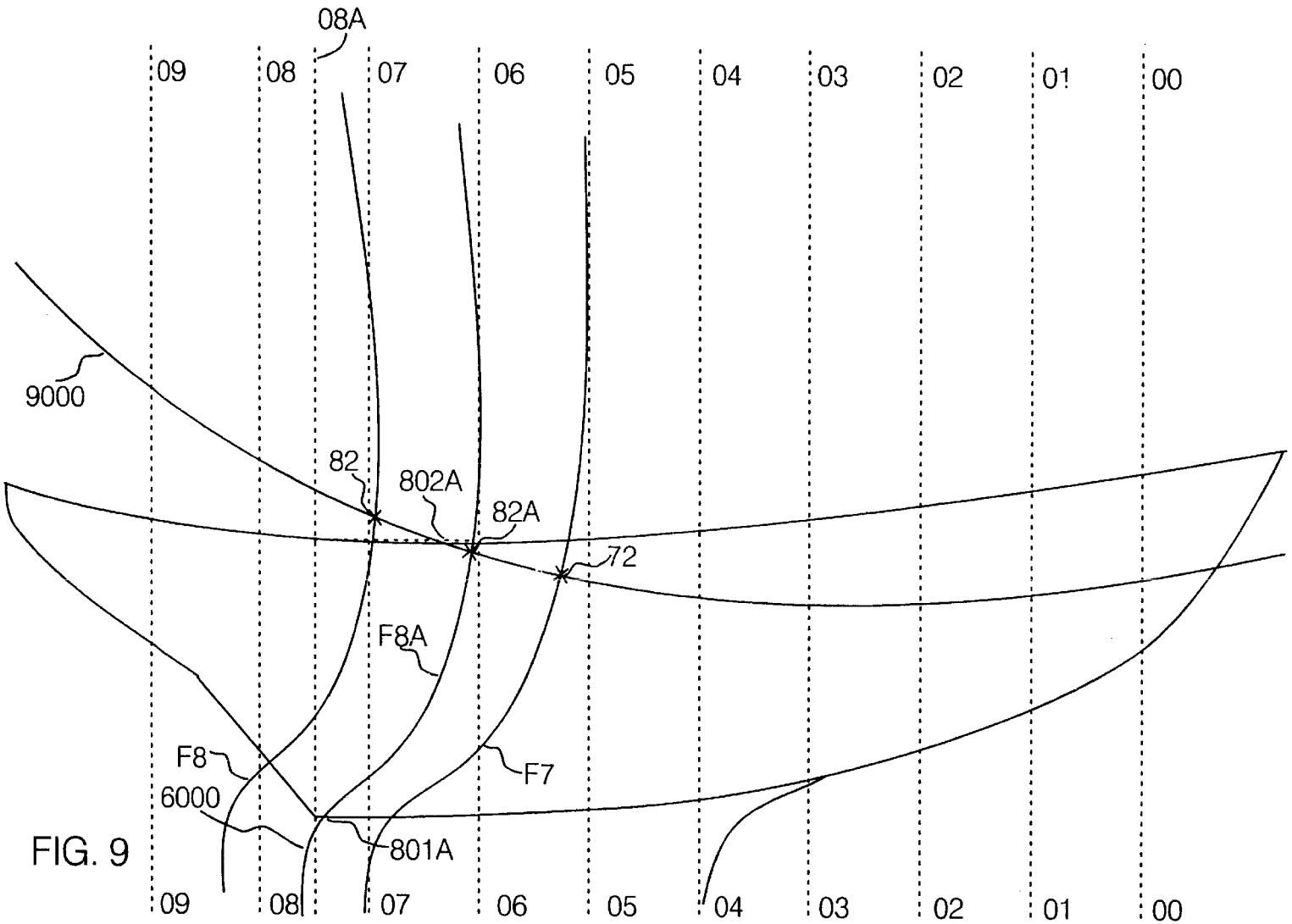
FIG. 9 shows the same view as in FIG. 8 but with an additional frame being interpolated between two of the initially chosen stations near the stern of the vessel.

The Reference Line 9000 being fair gives the designer the go-ahead to use the SFC template 7000 to add to the lines drawing the rest of the frames needed. From this point forward, there is an additional constraint on the designer's freedom of choice, a constraint provides an automatic enhancing of the fairness of the final design, a constraint that also speeds the drawing the remaining frames. The constraint is that when each frame is drawn with the SFC template 7000, the Reference Mark 8000 must lie directly above the Reference Line 9000. This is illustrated in FIG. 9, where frame F8 and frame F7 are shown explicitly, frame F8 intersecting Reference Line 9000 at frame F8 Reference Line point 82 and frame F7 intersecting the Reference Line 9000 at frame F7 Reference Line point 72. A frame F8A is to be interpolated so as to be forward of station 08 and aft of station 07. After drawing in the dashed lines to indicate the location of the sheer line and bottom line intersection points for station F8A, (and in particular their respective offset distances), the designer places the SFC template 7000 so that the Reference Mark 8000 lies on the Reference Line 9000 between the station 08 Reference Point 82 and a station 07 Reference Point 72. With the SFC template 7000 so positioned, it is slid along the Reference Line 9000 until one of the points on the SFC template 7000 overlays the keel line point 801A associated with station F8A. If this does not result in the SFC 6000 also passing through the sheer line intersection point 802A for station F8A, the designer moves the template 7000 slightly, while rotating it, until SFC template 7000 does pass through those two endpoints for frame F8A. In similar manner, all the rest of the needed frames that are needed are drawn in.

Figure 10:
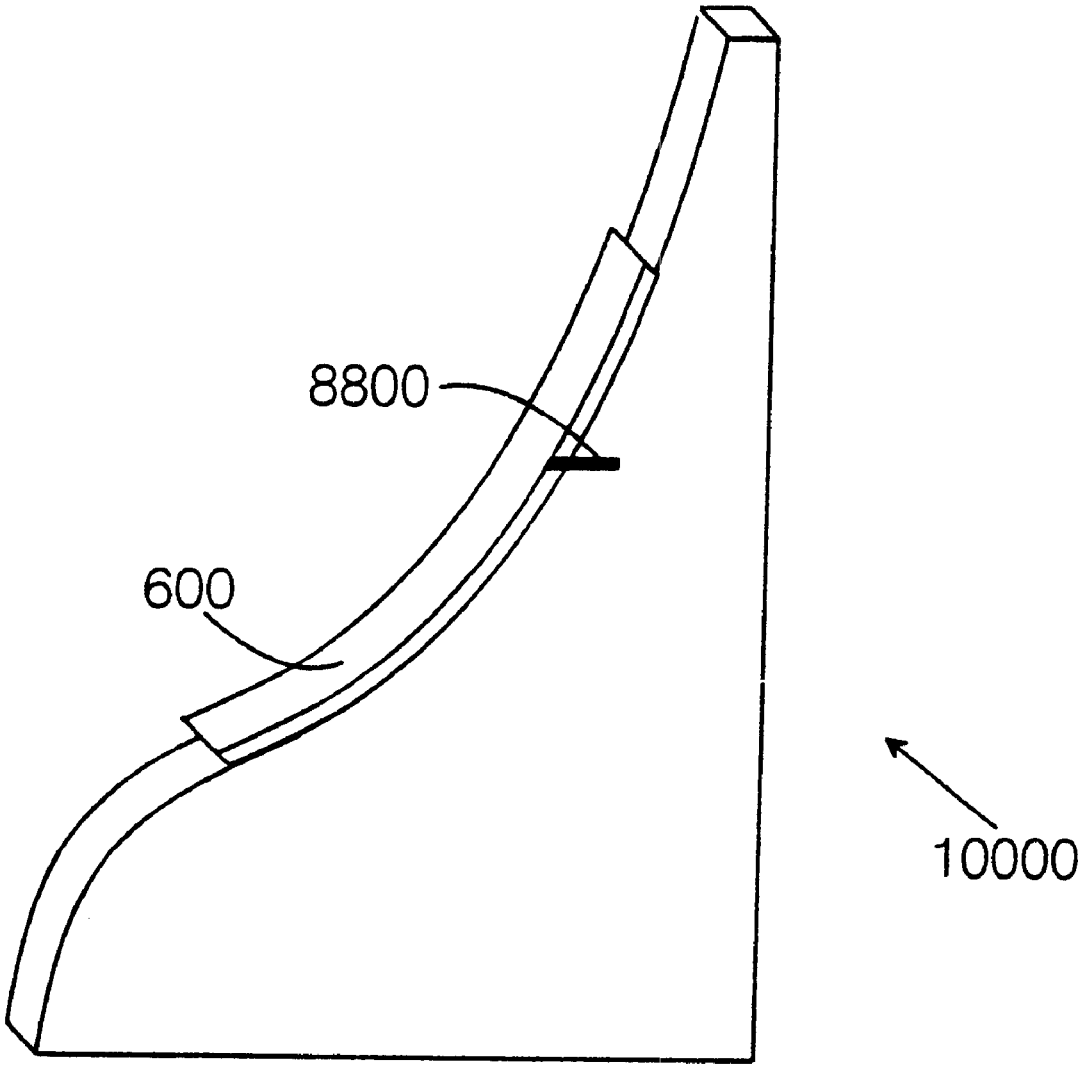
FIG. 10 shows a Master mold based on the full scale SLC template and used to shape the frames that will go into the hull construction.

At this point, the lines drawing is complete. Since this illustration of the invention is directed to the creation of a wooden hull, the procedure next calls for the lines drawing is to be lofted to a full-scale drawing on the floor of the boat shop where the vessel is to be constructed. In drawing the full-scale frames as part of this lofting, a full-scale SFC template (not shown, since it has the same shape as SFC template 7000) is created by scaling up the SFC template 7000. The full-scale SFC template is also used to produce a Master Mold 10000, on which is marked a Mold Reference Mark 8500, and which will be used to shape the bent frames to be used in the hull. This is illustrated in FIG. 10, where a frame element 600, after being softened by known techniques, is positioned on the Master Mold 10000, using the Mold Reference Mark 8500. Once aligned with the proper segment of the Master Mold 10000, the frame element 600 is affixed there for the period of time required for it to "remember" the shape given it by the Master Mold 10000. Prior to being so mounted, the frame element 600 is placed on top of the full-scale drawing of the frame it is to be made into, and marked or cut to the proper length. At that time, as the frame element 600 lies on the lofted lines drawing, the reference mark for frame element 600 is marked on frame element 600 by noting the point at which the full-scale Reference Line 9500 underlies the frame element 600. In this way all of the bent frames are created and eventually put in place as the skeleton of the hull (not shown) takes shape.

Concurrently, the full-scale SFC template is used to produce the sawed frames that the designer calls for. In this illustration, this is done simply by allowing the full-scale SFC template to serve as a guide to the saw that is cutting out the sawed frames from the composites of wood pieces that have previously been prepared for this purpose.

It will be clear that several of the details of the illustration set out above are specific to the production of wooden sailing vessels. From the SUMMARY and from their own knowledge and experience, however, boat designers and builders will readily understand how those details need to be modified when the method is applied to other types of vessels. The method applies to all frame-based vessels, and also to all vessels (such as fiberglass hulls) built using full size molds that themselves are frame-based.

I claim:

1. A method for systemizing the creation of original hull designs in such a way as to expedite the design process and the subsequent hull construction process, said method comprising the following steps:

(a) produce an initial scaled lines drawing depicting a new hull, including a stem and a stern from said new hull, said initial scaled lines drawing defining basic hull parameters and displaying a plurality of stations distributed along said hull wherein said plurality of stations includes a midships station located substantially midway between said stem and said stern and wherein said basic hull parameters include a sheer line, a bottom line, a half-keel line, and freeboard-defining waterline;

(b) create a midships frame drawing on said initial scaled lines wherein said midships frame drawing is associated with said midships station, and wherein said midships frame drawing obeys offset requirements associated with said sheer line and said half-keel line;

(c) determine from said midships frame drawing a midships frame drawing waterline offset point and, using said midships frame drawing waterline offset point, complete a design waterline (DWL) around an entire circumference of said hull;

(d) extend said midships frame drawing at both ends thereof so as to produce a Single Frame Curve;

(e) transfer said Single Frame Curve to a translucent sheet;

(f) moving said translucent sheet to a second one of said plurality of stations on said initial scaled lines drawing, and modifying said Single Frame Curve if necessary, locate a second segment on said Single Frame Curve such that said second segment has a shape and length permitting said second segment to outline a second frame complying with said offset requirements of said sheer line and said half-keel line and also complying with an offset requirement established by said design water line;

(g) use said Single Frame Curve at each of said plurality of stations to draw a corresponding frame that lies on a segment of said operational Single Frame Curve.

2. The method as described in claim 1 also comprising the following additional steps:

(a) cut a sheet of material so that an edge of said sheet conforms to said Single Frame Curve, thereby creating a template;

(b) use said template to draw all additional frames needed for said hull.

3. The method as described in claim 2 also comprising the following steps:

(a) place a Reference Mark near a mid-point of said edge;

(b) at each station where said template is used to draw a frame, mark on said lines drawing where said Reference Mark is as said frame is being drawn, thereby creating a plurality of Reference Points on said lines drawing;

(c) create a Reference Line by drawing a smooth line joining in an adjacent-pairwise fashion all of said plurality of Reference Points.

4. The method as described in claim 3 also including a step wherein said Reference Line is evaluated for fairness and wherein, should said Reference Line not be fair, making further iterative modifications to said template and to said scaled line-drawing until said Reference Line becomes fair.

5. The method as described in claim 3 including an additional step of lofting said scaled lines drawing so as to create a full scale drawing of said hull.

6. The method as described in claim 5 including a further step of transferring each said corresponding frame at each of said plurality of stations to a mold for constructing a corresponding physical frame.

7. A method for creating a frame-based hull having a shape original to said frame-based hull, said method comprising the steps of:

(a) creating a half-breadth top-view drawing of said hull and a side-view drawing of said hull, said top-view drawing and said side-view drawing in combination defining certain basic hull parameters, said basic hull parameters including a sheer line, a bottom line, and a vertically defined waterline, said top-view drawing to be placed directly above and be aligned with said side-view drawing;

(b) drawing a centerline on said top-view drawing, said centerline to be a reference from which to measure outboard distances, and drawing a plurality of vertical lines to define positions of a plurality of stations located on said hull at respective positions distributed from a stem of said hull to a stern of said hull;

(c) choosing a midships frame shape and drawing said midships frame shape at a midships station on said side-view drawing, wherein said midships frame shape extends from a midships bottom-line-intersection point, up to a midships sheer-line-intersection point, after determining graphically from said top-view drawing a midships-sheer-line-intersection-point offset;

(d) determining from said side-view drawing a midships-waterline-intersection-point and a midships-waterline-intersection-point offset and marking said midships-waterline-intersection point on said top-view drawing;

(e) choosing a waterline hull contour that includes said midships-waterline-intersection point and drawing said waterline hull contour on said top-view drawing;

(f) transferring said midships frame shape to a piece of translucent material and then adding a top extension and a bottom extension to said midships frame shape so as to create a Single Frame Curve, subject to a condition that that said top extension and said bottom extension permit a use of said Single Frame Curve to draw a fore frame and an aft frame, wherein said fore frame is to be located at a fore region of said hull and to follow said shape of said hull thereat and said aft frame is to be located at an aft region of said hull and to follow said shape of said hull thereat;

(g) creating a Single Frame Curve template by cutting a piece of thin stiff material so as to give said material an edge shaped identically to said Single Frame Curve;

(h) placing at approximately a midpoint of said edge a Reference Mark on both sides of said material;

(i) using said Single Frame Curve template to draw a plurality of specific frames at said stations on said side-view drawing so that each of said specific frames satisfies all offset constraints built into said hull thus far;

(j) placing on each of said stations a mark where said Reference Mark overlay said each of said stations when a frame associated with said each of said stations was being drawn using Single Frame Curve template, so as to create a plurality of marks on said side-view drawing;

(k) smoothly connecting said plurality of marks so as to make a Reference Line on said side-view drawing and noting whether said Reference Line is fair;

(l) using said SFC template to draw all additional frames needed for said hull, ensuring that as said additional frames are drawn that said Reference Mark is always lying directly above said Reference Line, thereby completing a scaled lines drawing;

(m) making a full-size template from said SFC template;

(n) using said full-size template to complete a lofting of said lines drawing;

(o) using said full-size template to produce a master mold;

(p) using said master mold to produce bent frames for construction of a hull based on said lines drawing.

8. The hull-drawing-preparation method as described in claim 6 also including the step of marking said template with a Reference Mark in a center region of said edge so that said Reference Mark appears on both a starboard side and on a port side of said template.

9. A method using the template containing the operational single-frame curve and Reference Mark, the operational top-view and the operational side-view constructed according to the hull-drawing-preparation method of claim 7, said hull-drawing method comprising the steps of:

(a) adding to said side-view a plurality of vertical lines, said plurality of vertical lines extending from a stern end of said side-view to a stem end of said view;

(b) placing said template at each of said plurality of vertical lines in turn so that a segment of said single-frame curve lines up with a frame of said hull;

(c) noting at each said placing where said Reference Mark aligns with said side-view drawing and marking said side-view drawing opposite said Reference Mark so as to make a plurality of Reference Points on said side-view drawing;

(d) drawing a Reference Line through all of said plurality of Reference Points;

(e) determining that said Reference Line is fair;

(f) proceeding to use said template to draw in as many more frames as are needed to complete said hull-drawing to a point where said hull-drawing can be used to construct a hull.

10. A boat hull constructed by the method claimed in claim 9.

* * * * *